US009201401B2

(12) United States Patent
Springer

(10) Patent No.: US 9,201,401 B2
(45) Date of Patent: Dec. 1, 2015

(54) TIMEPIECE WITH DISPLAY DEVICES

(75) Inventor: Simon Springer, Bern (CH)

(73) Assignee: The Swatch Group Research and Development Ltd., Marin (CH)

( * ) Notice: Subject to any disclaimer, the term of this patent is extended or adjusted under 35 U.S.C. 154(b) by 304 days.

(21) Appl. No.: 13/588,230

(22) Filed: Aug. 17, 2012

(65) Prior Publication Data

US 2013/0051189 A1 Feb. 28, 2013

(30) Foreign Application Priority Data

Aug. 22, 2011 (EP) ..... 11178312

(51) Int. Cl.

| | |
|---|---|
| ***G04C 17/00*** | (2006.01) |
| ***G04B 19/00*** | (2006.01) |
| ***G04G 9/00*** | (2006.01) |

(52) U.S. Cl.

CPC ..... *G04B 19/00* (2013.01); *G04C 17/0091* (2013.01); *G04G 9/0082* (2013.01); *G04G 9/0064* (2013.01)

(58) Field of Classification Search

CPC ..... G04B 45/00; G04B 19/16
USPC ..... 368/231, 69, 223
See application file for complete search history.

(56) References Cited

U.S. PATENT DOCUMENTS

| | | | | |
|---|---|---|---|---|
| 7,889,602 | B2 * | 2/2011 | Behling et al. | 368/10 |
| 2004/0013042 | A1 | 1/2004 | Farine | |
| 2004/0047242 | A1 | 3/2004 | Germiquet et al. | |
| 2008/0062818 | A1 | 3/2008 | Plancon et al. | |

FOREIGN PATENT DOCUMENTS

EP 1 701 229 A1 9/2006

OTHER PUBLICATIONS

European Search Report issued Nov. 7, 2011, in European Patent Application No. 11178312.2, filed Aug. 22, 2011.

* cited by examiner

*Primary Examiner* — Sean Kayes
(74) *Attorney, Agent, or Firm* — Oblon, McClelland, Maier & Neustadt, L.L.P.

(57) ABSTRACT

A watch including a case in which there is arranged a control system, which includes a time base and is arranged to be able to perform several functions, the watch further including at least two analog display elements and a digital display controlled independently by the control system, the watch further including a control acting on the control system. The watch is arranged in a first, normal operating mode to provide the user with a time indication by the analog display elements driven by the control system fitted with the time base, and the watch is arranged in a second, special operating mode to allow the user to select a function via the control, to display on the digital display a value associated with the selected function, and to move an analog display element opposite the value associated with the selected function.

22 Claims, 11 Drawing Sheets

TIMEPIECE WITH DISPLAY DEVICES

This application claims priority from European Patent Application No. 11178312.2 filed Aug. 22, 2011, the entire disclosure of which is incorporated herein by reference.

The present invention concerns a watch which comprises a case in which there is arranged a control system, which includes a time base and which is arranged to perform several functions. The watch also includes at least two analogue display elements and digital display means, which are independently controlled by said control system. The watch further includes a control means acting on said control system.

BACKGROUND OF THE INVENTION

Watches comprising several display devices are known in the prior art. This multiple display includes hands and at least one LCD screen arranged, for example, underneath the watch dial. The LCD screen is, in this case, visible through an aperture made in the dial. This allows such watches to display time information with the hands and other information with the LCD screen. A known variant is a watch comprising two LCD screens in order to display several pieces of information.

However, the drawback of these watches is that the information is very complex to read. Indeed, the LCD screen or screens of these watches simultaneously display a multitude of information so that the user cannot intuitively tell from the screen(s) which function is being used. This then leads to confusion for the user in handling the watch and in the selection of the desired function from the various functions proposed, and confusion in reading the various information displayed.

A watch comprising hands and an LCD screen and provided with a tactile watch crystal is also known in the prior art. This watch is arranged to perform several functions. In normal operating mode, the hands are used to indicate time information via indications on the dial. In a second operating mode, the user can choose one of the watch functions. To do so, the user selects the function via action with one finger on the tactile crystal. The indications concerning the various available functions are located on the dial, the flange of the crystal or the bezel. Pressing on or touching the crystal on the desired function indication selects said function. This causes a movement of the hands to point to the indication relating to said selected function. The LCD screen then displays the result associated with the selected function.

However, the drawback of this watch or timepiece is that it does not allow several different pieces of information to be displayed at the same time. Indeed, it is not possible to display information, such as the temperature, at the same time as pressure information. It is also not possible to display simultaneously different temperature data such as the mean value, instantaneous value or other data. Added to this is the fact that it is not possible to display hierarchical information, i.e. the function and menu attached to said piece of displayed information.

Moreover, this timepiece has the additional drawback of only having a limited number of functions. Indeed, the list of the various functions is set out on the timepiece dial, dial flange or bezel. The surface area of these elements is limited, thus the number of functions is consequently limited to this available surface area on said elements.

SUMMARY OF THE INVENTION

It is an object of the invention to overcome the aforementioned drawbacks by proposing a watch with a display which allows the user to be aware of several pieces of information simultaneously and in a legible, intuitive manner.

The invention therefore concerns the aforecited watch, which is characterized in that said watch is arranged, in a first, normal operating mode, to provide the user with a time indication via at least the two analogue display elements driven by the control system provided with the time base, and in that the watch is arranged, in a second, special, operating mode, to allow the user to select at least one of the functions via the control means, to display on the digital display means at least one value or parameter associated with the at least one function selected by the control means, and to move at least one of the analogue display means opposite the value or parameter associated with the selected function.

Advantageous embodiments of this timepiece form the subject of the dependent claims 2 to 16.

In a first, advantageous embodiment, the watch is arranged, in a second, special operating mode, to allow the user to select at least one of the functions via the control means, to display on the digital display means indications of the watch functions and at least one value or parameter associated with the at least one function selected by the control means, and to move one of the analogue display means opposite the indication of the selected function and the other analogue display element opposite the value of the parameter associated with the selected function.

In a second advantageous embodiment, the digital display means includes several digital display sectors arranged on a dial or under a pierced or semi-transparent dial of said watch, each display sector being arranged, in the second operating mode, to display an indication of one of the functions of said watch, or a value or parameter associated with a selected function.

In a third advantageous embodiment, the digital display means includes at least twelve digital display sectors arranged on the periphery of the dial like hour symbols.

In another advantageous embodiment, the digital display means further includes at least one digital display sector arranged inside the circle formed by the at least twelve digital display sectors arranged on the periphery of the dial.

In another advantageous embodiment, said watch includes three hands and in the second operating mode of the watch, a first analogue display element is provided to point in the direction of the indication of a selected function, a second analogue display element is used to point in the direction of a first value or a first parameter associated with a selected function, and a third analogue display element is used to point in the direction of a second value or a second parameter associate with the selected function.

In another advantageous embodiment, the third analogue display element is arranged to merge with the first or second analogue display element.

In another advantageous embodiment, the functions are grouped together in various menus and said watch includes three analogue display elements so that, in the second operating mode of the watch, a first analogue display element points in the direction of the indication of one of the selected menus, a second analogue display element points in the direction of the indication of a selected function and a third analogue display element is used to point in the direction of a value or parameter associated with the selected function.

In another advantageous embodiment, each digital display sector is arranged to display information in a first colour on a background in a second colour, which may be identical to the colour of the watch dial.

In another advantageous embodiment, the shape, number, size, first and second colours or position of the digital display sectors change according to the menu or function selected.

In another advantageous embodiment, the analogue display elements are hands,

In another advantageous embodiment, the analogue display elements are discs.

In another advantageous embodiment, the digital display means takes the form of a single substrate on which several digital display sectors are formed.

In another advantageous embodiment, the digital display sectors are formed by the pierced dial.

In another advantageous embodiment, the digital display means takes the form of several substrates each forming a digital display sector.

In another advantageous embodiment, the watch is arranged, in the second, special operating mode, to continue to provide the user with a time indication via at least the two analogue display elements.

One advantage of the present invention is that the user can visualise several pieces of information quickly and intuitively in a hierarchical manner. Indeed, combining an analogue display and a digital display means that the flexibility of a digital display can be used with a simple information display owing to the hands or discs. Indeed, a watch with an analogue display, such as, for example, hands, has the drawback of not being able to display a large number of different pieces of information, since this would require too many hands and would thus make the watch impossible to read. Conversely, a digital display allows a lot of information to be displayed sequentially, since the digital screens are totally flexible and thus different scales can be used according to the desired function.

Another advantage is that the various information can be hierarchised so that all the functions of the portable object are easy to access, readable and easy to find. Indeed, by hierarchising the various functions in different menus, it is easier for the user to find the desired function.

Another advantage of the watch of the present invention is that its attractiveness is improved. Indeed, it is possible to have LCD screens displaying information in a first selected colour on a background in a second colour, which is for example identical to the colour of said watch dial. For example, if the watch dial is black, the LCD screen or screens are arranged so that the information is visible in a light colour on a dark background. This also camouflages the presence of the LCD screens, of which there may be many, as much as possible.

The present invention also relates to a method of operating the above watch, characterized in that it includes the following steps:

a) Changing from a first, normal, operating mode, in which the two hands are driven by the control system, fitted with the time base, to supply a time indication, to a second, special operating mode, via the action of the control means.

b) Automatically displaying via the digital display means, in the second operating mode, indications relating to the functions that said watch can perform.

c) Selecting the desired function by actuating the control means, with a first display element automatically moved in the direction of the indication of the desired function.

d) Automatically displaying, via the digital display means, at least one value or parameter associated with said selected function, with a second analogue display element automatically moved in the direction of the value or parameter displayed.

One advantage of this method is that the user can have a watch of simple appearance, yet which can display several pieces of information quickly and in an easily readable manner. Indeed, the two operating modes mean that, on the one hand, said watch can indicate the time in normal time, like a conventional watch, but can also, on the other hand, use various functions in a second operating mode. This avoids overloading the dial and reducing the readability of information.

Advantageous embodiments of this method form the subject of the dependent claims 18 to 23.

In a first embodiment of the invention, the digital display means includes several digital display sectors, which are distributed at the periphery of the watch dial, characterized in that in the second operating mode, each digital display sector displays one indication of one of the functions or one value or parameter associated with the selected function.

In a second embodiment of the invention, between step c) and step d), the method includes a step consisting in erasing the contents of all of the digital display sectors with the exception of the one indicating the selected function, and in step d), a range of values is indicated by some digital display sectors which were previously erased or extinguished, and the second hand is moved in the direction of the value associated with the selected function.

In another embodiment of the invention, the watch functions are grouped together in different menus and said method includes the following steps:

a) Changing from a first, normal, operating mode, in which the two analogue display elements are driven by the control system, fitted with the time base, to supply a time indication, to a second, special operating mode, via the action of the control means.

b) Automatically displaying via the digital display means, in the second operating mode, indications relating to the functions that said watch can perform.

c) Selecting the desired menu by actuating the control means, with a first analogue display element simultaneously moving in the direction of the selected menu.

b) Automatically displaying, via the digital display means, indications relating to the functions grouped together in said menu which said watch can perform.

c) Selecting the desired function by actuating the control means, with a second analogue display element automatically moved in the direction of the indication of the desired function.

d) Automatically displaying, via the digital display means, at least one value or parameter associated with said selected function, with a third analogue display element automatically moved in the direction of the displayed value or parameter.

In another embodiment of the invention, between step c) and step d), the method includes a step consisting in erasing the content of all of the digital display sectors, with the exception of the sector indicating the selected menu, and in step d), the functions grouped together in the selected menu are displayed by certain digital display sectors which were previously erased or extinguished, and the second analogue display element is moved in the direction of the selected function, and between step e) and step f) the method includes a step consisting in erasing the content of all of the digital display sectors with the exception of those which indicate the selected menu and the selected function, and in step f) a range of values is displayed by certain digital display sectors which were previously erased or extinguished, and the third analogue display element is moved in the direction of the value associated with the selected function.

In another embodiment of the invention, the analogue display elements are hands.

In another embodiment of the invention, the analogue display elements are discs.

BRIEF DESCRIPTION OF THE DRAWINGS

The objects, advantages and features of the watch according to the present invention will appear more clearly in the following detailed description of embodiments of the invention, given solely by way of non-limiting example and illustrated in the annexed drawings, in which.

DETAILED DESCRIPTION OF THE INVENTION

Figure 1:
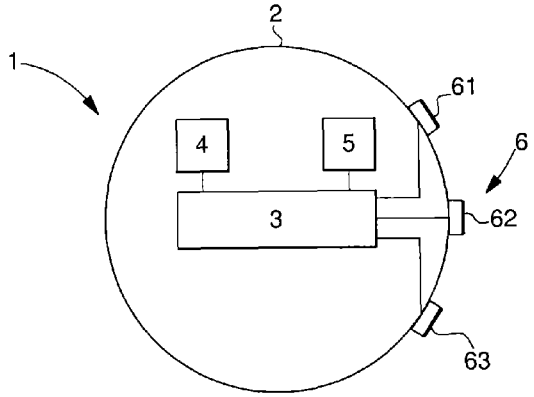
FIG. 1 shows schematically elements of the watch according to the present invention.

FIG. 1 is a schematic view of the watch according to the present invention. This watch 1 includes a watch case 2 in which a control system 3 is arranged. This control system 3 controls analogue display means 5 and digital display means 4. Control system 3 can be controlled by a control means 6, generally arranged on the exterior of watch case 2. It will be clear that the present invention may be implemented in a watch acting as a GPS or measuring instrument.

Figure 2:
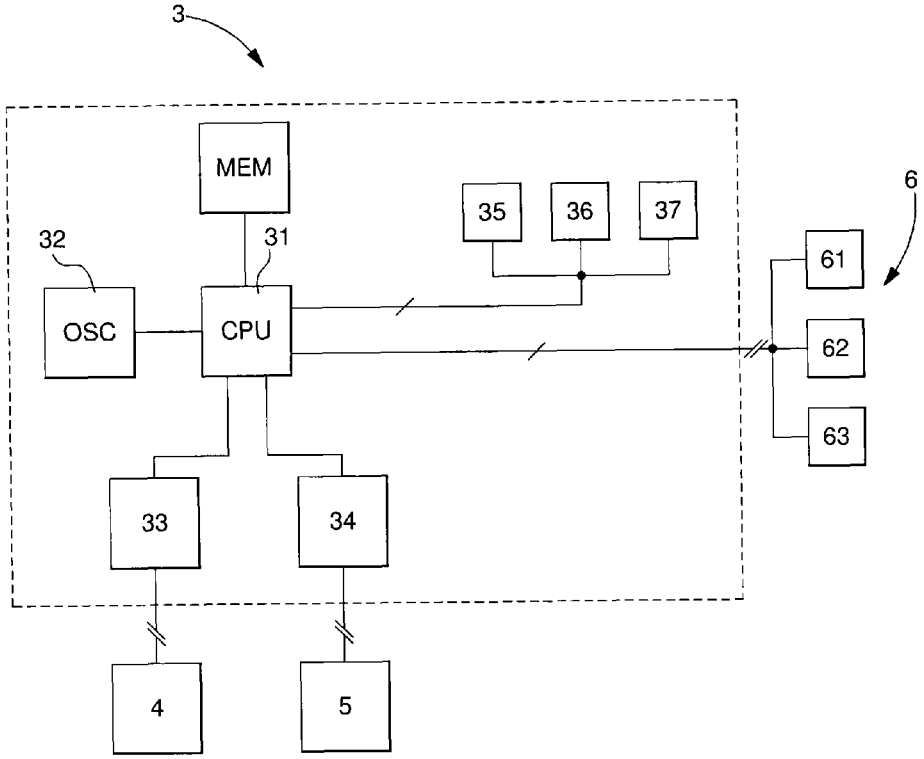
FIG. 2 shows schematically the watch control system according to the present invention.

Control system 3, shown in FIG. 2, includes a processor or CPU 31 controlling the functions of watch 1. This processor 31 is associated with a time base or oscillator circuit 32, so as to supply a time indication such as the time and date. Processor 31 is also associated with a means of storage, such as a RAM or ROM memory. A time indication supplied by time base 32 is transmitted to analogue display means 5 or to digital display means 4, via, respectively, an analogue display control means 34 or digital display control means 33. These control means 33, 34 are arranged to convert the information delivered by processor 31 and transfer said information to the analogue/digital display means.

However, the time information, i.e. the time or date, is not the only information that can be displayed. Indeed, control system 3 may include several sensors, for example three sensors 35, 36, 37 arranged in the watch and responsible for carrying out measurements of at least one physical parameter. For example, it is possible to envisage one sensor being arranged to measure the temperature, one sensor to measure the pressure and one sensor to measure the earth's magnetic field. These sensors 35, 36, 37 are managed by processor 31.

These sensors 35, 36, 37 are intended to be controlled by the user via control means 6. Control means 6, shown in FIGS. 1 and 2, includes for example three buttons 61, 62 and 63. Control means 6 acts on processor 31 so that the user can act on control system 3 to set said watch 1 or activate its functions. It is also possible to envisage the three buttons 61, 62 and 63 being replaced or completed by a tactile interface. This tactile interface may take the form, for example, of capacitive or resistive discs placed opposite the digital display means so that the user presses on or touches the capacitive or resistive disc placed opposite a digital display means to select said means. Further, it is possible to envisage control means 6 including a rotating bezel used as a means of selection for choosing the various information such as the menus or functions.

When one of sensors 35, 36 and 37 is activated, said sensor carries out the desired measurement and transmits the measurement result to processor 31. The latter decodes then processes said information to transmit it to analogue display means 5 or digital display means 4. It is thus clear that analogue display means 5 or digital display means 4 are modified automatically.

Figure 3:
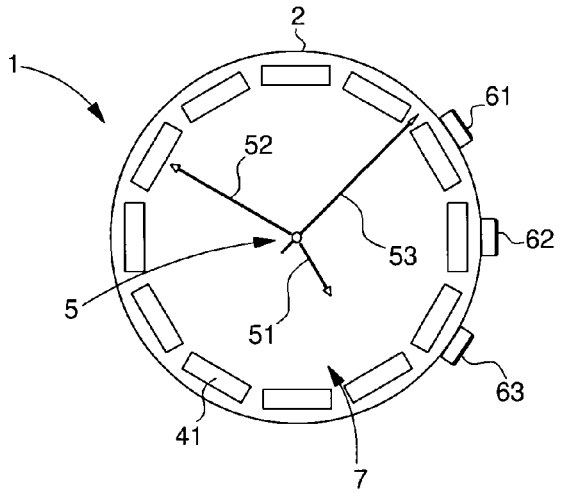
FIG. 3 is a simplified top view of the watch according to the invention.

To be able to manage all the functions and to achieve a legible and intuitive display, analogue display means 5 and digital display means 4 are arranged to cooperate with each other. Dial 7 of watch 1 is therefore arranged, for example, as shown in FIG. 3. Analogue display means 5 of the present invention comprises analogue display elements which take the form of hands, but may take the form of discs. In the following description, the analogue display elements will be hands. Preferably, three hands 51, 52 and 53 are provided for respectively displaying the hours, minutes and seconds. These hands 51, 52, and 53 are each driven by electric motors controlled by the analogue display control means 34. This enables hands 51, 52 and 53 to be independent of each other. However, it is possible to use only one motor to drive the three hands 51, 52, and 53. A coupling system is used to drive the hands independently of each other.

Digital display means 4 takes the form of at least one digital indicator 41 or digital display sector. In this embodiment, dial 7 has twelve digital indicators 41, for example of the LCD type, arranged on the periphery of said dial 7 so as to represent an hour circle. These LCD indicators 41 are controlled by digital display control means 33 so that each indicator 41 can be controlled independently. Of course, the number and technology of indicators 41 are not limited to this embodiment. Further, it is possible to envisage indicators 41 being individually manufactured, i.e. each indicator 41 is manufactured from its own substrate. It is also possible for indicators 41 to be made from the same substrate, but with independent addressing for each area where information will be displayed. This substrate may have an equivalent surface area to that of dial 7 of watch 1 which carries it.

Further, these indicators or digital display sectors 41 may be arranged so that their presence is as unnoticeable as possible to the user. To achieve this, they are arranged to display information in a first colour on a background in a second colour. The camouflage is achieved in that the second background colour is identical to the colour of the watch dial. The first colour contrasts with the second colour. For example, if the dial is black, the second colour will be black and the first colour will be a light colour such as yellow, beige or white. This then means that the presence of indicators or digital display sectors 41 is not noticed or hardly noticed.

Figure 4A:
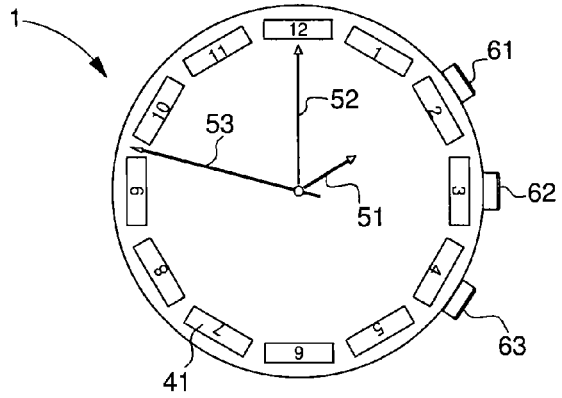
FIGS. 4*a*, 4*b* and 4*c* show a first embodiment of the watch according to the present invention.

In a first, normal, operating mode, control system 3 acts on the watch so that it operates like a normal watch, as shown in FIG. 4*a*. The watch therefore indicates the time to the user. To achieve this, each digital indicator 41 displays a number between 1 and 12 so as to imitate the hour circle of a dial 7 of watch 1. Hands 51, 52 and 53 point to indicators 41 according to the time data provided by processor 31. An improvement to this display consists in providing a 12 h-24 h hour display which is characterized by indicators 41 displaying the time from 1 o'clock to 12 o'clock in the first part of the day and afterwards displaying the time from midday to midnight in the second part of the day. This 12 h-24 h display is characterized in that indicators 41 display an hour circle from 1 o'clock to 12 o'clock when the time is comprised in this period from 1 o'clock to 12 o'clock. Then indicators 41 display an hour circle from 13 h to 24 h when the time is comprised within this period.

In a second, special, operating mode, watch 1 is arranged so that the user can use integrated functions. In a first step, the user acts on control means 6 to actuate this second operating mode. In particular, control means 6 will be arranged so that button 62 is used to set the time and buttons 61 and 63 are arranged to actuate the second operating mode and select/actuate the various functions.

Figure 4B:
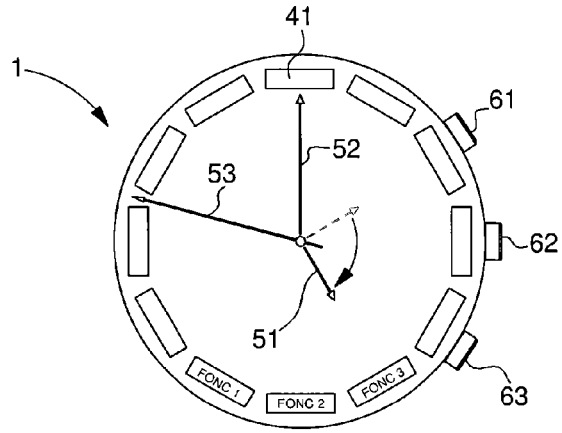

In a first embodiment, this actuation via control means 6 which forms a first step, causes a modification in the display. This modification is that all of indicators 41 are extinguished. This modification is visible in FIG. 4*b*, where, in a second step, LCD indicators 41, whose position corresponds, for example, to the time indications 5 o'clock, 6 o'clock and 7 o'clock, automatically display the various available functions between [fonc 3], [fonc 2] and [fonc 1]. The user then selects the desired function by acting on control means 6. In the example of FIG. 4*b*, when the user selects a function, hour hand 51 automatically moves to point to the selected function, in this case, it points to function [fonc 3].

Figure 4C:
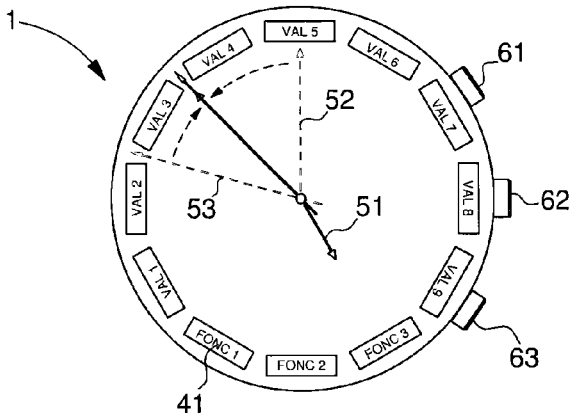

In a third step shown in FIG. 4*c*, the other indicators 41, i.e. LCD indicators 41, whose position corresponds, for example, to the 8 o'clock to 4 o'clock time indications, automatically display a continuous range of values [val 1] to [val 9]. This range of values [val] is defined by the function used. For example, in the case of a temperature function and a measured temperature of 23.5° C., the LDC screens may display a range of between 21° C., displayed by the indicator 41 indicating the value [val 1], to 29° C., displayed by the indicator 41 indicating the value [val 9]. The minute hand 52 then moves automatically to point to the measured value. In this case, said hand 52 points between the values [val 3] and [val 4]. This immediately enables the user to see the function he has selected and the measured value. It is possible to envisage that indicators 41 displaying the functions [fonc] have a background in a certain colour and that indicators 41 displaying the values [val] have a different colour from the background of indicators 41 displaying the functions [fonc]. This therefore improves the distinction between indicators 41. This configuration may be adopted in all the variants described or devised by those skilled in the art and may be extended to the distinction between the actual values [val].

Since seconds hand 53 is not being used, it is possible to envisage automatically moving said hand so that it merges with minute hand 52 and does not cause inconvenience when information is read.

The advantage of having a range of values [val] rather than a single indicator 41 displaying the measured value is that reading is simplified when there is a series of measurements. Indeed, for a series of measurements whose associated values [val] only vary slightly, a relatively broad range of values [val] means that only the position of hand 53 pointing to said measured values is modified. The display is therefore more intuitive and the user can immediately see the variation. In the example of temperature measurement, with a measured value of 23.5° C. and a range of value between 21° C. and 29° C., it is possible for the information displayed by indicators 41 not to vary if the second measurement indicates a value of 24° C. and the third indicates 24.5° C.

Figure 5A:
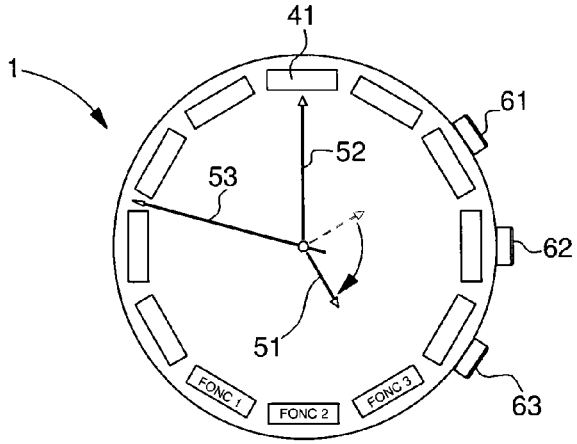
FIGS. 5*a* and 5*b* show a first variant of the first embodiment of the watch of the present invention.

In a first variant of this first embodiment shown in FIG. 5*a*, indicators 41 are configured in the same arrangement as previously described. The principle remains identical and the second step consists in allowing the user to select a function [fonc], hour hand 51 moves automatically to point to the selected function [fonc], in the present case, it points for example to function [fonc 3].

Figure 5B:
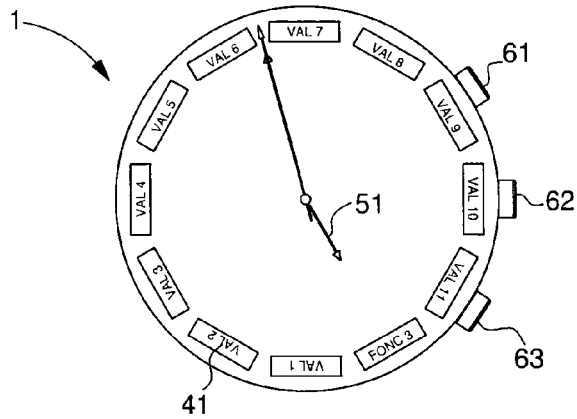

However, between the second and third step, the indicators 41 displaying the functions [fonc] that have not been selected, are automatically erased or extinguished, i.e. in the example shown in FIG. 5*b*, indicators 41 displaying the functions [fonc 1] and [fonc 2]. This means that there can be a larger number of indicators 41 for displaying the range of values [val] associated with said function [fonc]. This range consequently includes a larger number of indicators 41 and thus values [val] providing, as desired, either a broader or more precise range.

This means that, in the third step, indicators 41 which were previously erased or extinguished automatically display the range of values [val 1] à [val 11]. Minute hand 52 moves, without any action by the user, to point to the measured value [val]. In this case, said hand 52 points to between the values [val 6] and [val 7]. It is possible for indicators 41 to have a different background colour depending upon the function [fonc] with which they are associated. This means that each indicator 41 can easily be linked to a function [fonc], with each indicator 41 displaying a function [fonc] having a specific background colour. It is also possible, generally, for each category of information to be displayed on a defined background colour representative of said category.

Figure 6A:
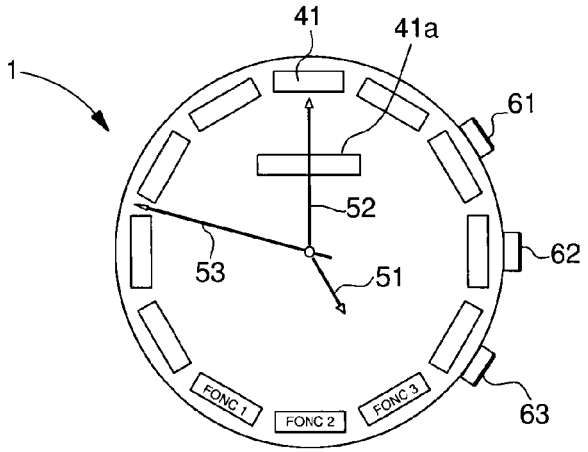
FIGS. 6*a* and 6*b* show a first alternative of the first embodiment of the watch according to the present invention.
Figure 6B:
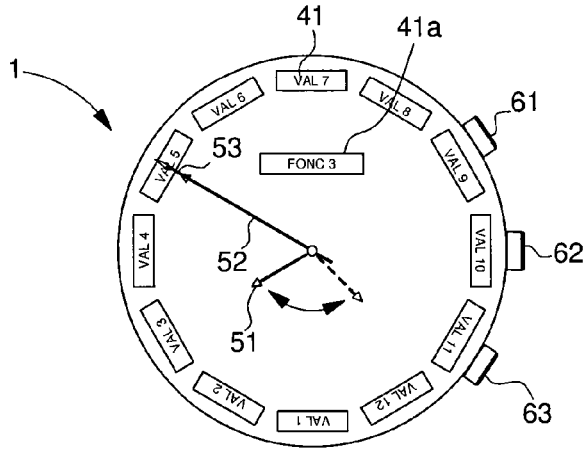

In a first alternative of this first embodiment where two hands are used for the hours 51 and minutes 52, it is possible to display two pieces of value information. To do this, dial 7 further includes a central indicator 41*a* as seen in FIG. 6*a*. This central indicator 41*a* is used to display the selected function and has two advantages. Indeed, once the function [fonc] has been selected, first of all said function can be better distinguished since it is displayed on central indicator 41*a* as seen in FIG. 6*b*. Secondly, this arrangement allows all of indicators 41 to be used to display values [val]. The two hour and minute hands 51, 52 are then moved and used to display different information such as, for example, a desired value and the measured value. Seconds hand 53 may then be merged with minute hand 52.

Figure 7A:
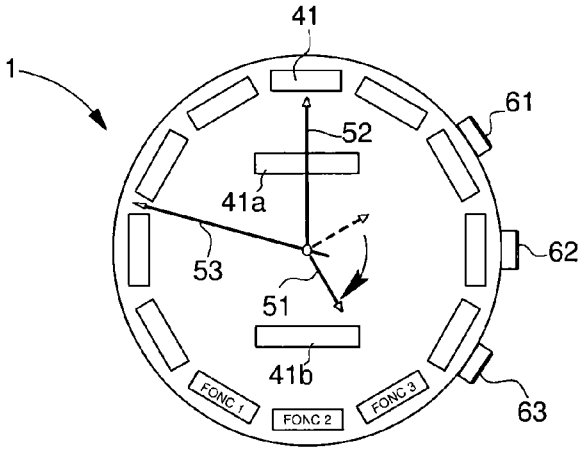
FIGS. 7*a*, 7*b* and 7*c* show a second alternative of the first embodiment of the watch according to the present invention.

In a second alternative shown in FIG. 7*a*, it is possible to display at least two pieces of value information for two different functions [fonc]. To do this, dial 7 has two central indicators 41*a* and 41*b* for displaying a first function [fonc_1] and a second function [fonc_2]. In fact, the functions [fonc] are first of all displayed on indicators 41. The user selects a first function [fonc] which will then be displayed on indicator

Figure 7B:
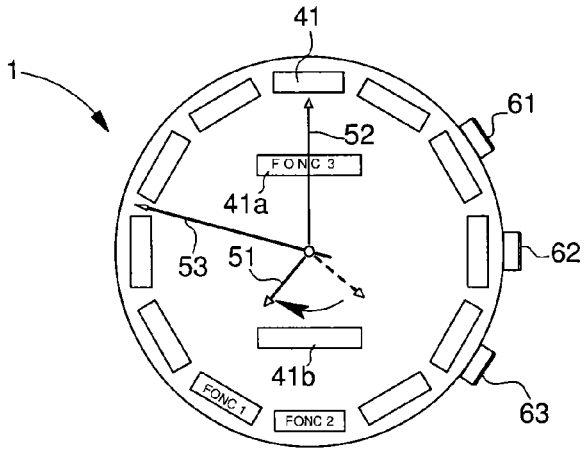
Figure 7C:
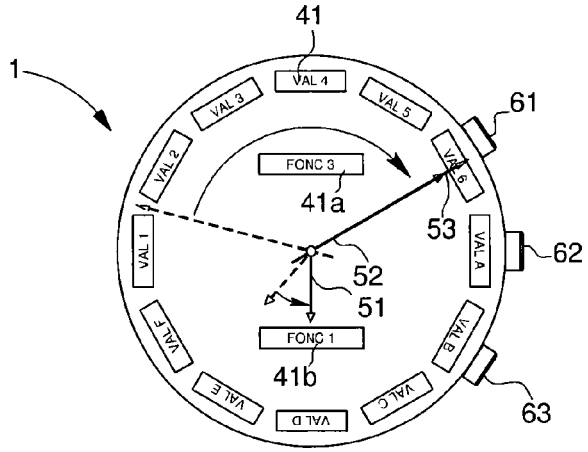

41*a*, as seen in FIG. 7*b*. Then he selects a second function [fonc] which will then be displayed on indicator 41*b* as seen in FIG. 7*c*. The indicators 41 are then separated into two groups each forming a range of value [val] each linked to a function [fonc] with respectively the values [val 1] to [val 6] for function [fonc_3] and values [val A] to [val F] for function [fonc_1]. Each of hour hand 51 and minute hand 52 is then linked to a range of values [val] to display the calculated and/or measured result linked to the function [fonc]. Hand 51 is linked to function [fonc1] and hand 52 is linked to function [fonc3]. It could therefore be envisaged that the indicators 41 associated with each function [fonc] can be distinguished from each other. One solution consists in differentiating them by using different background colours. Seconds hand 53 can then move to merge with minute hand 52 as seen in FIG. 7*c*.

In a second embodiment, the three hands 51, 52 and 53 are used.

Figure 8:
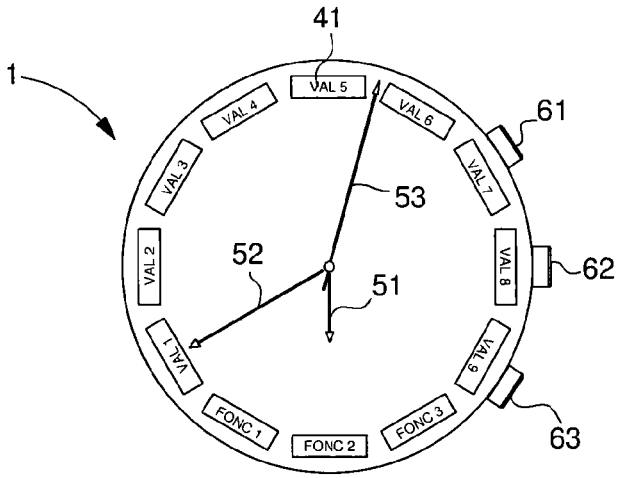
FIGS. 8 and 9 respectively show a second embodiment and a first alternative of this second embodiment of the watch according to the present invention.

First of all, this seconds hand 53 is used to point to another value [val] linked to the selected function [fonc] as seen in FIG. 8. For example, this seconds hand 53 could be used to point to the preceding measured value [val] or to a threshold value or desired value. The scale of the range displayed by indicators 41 is then modified, without any action by the user, to take account of this new value [val] associated with the selected function [fonc]. In a variant, the indicators 41 displaying the unused functions [fonc] are erased. This means that a larger range of values [val] can be obtained and therefore, as required, a broader or more precise range.

Figure 9:
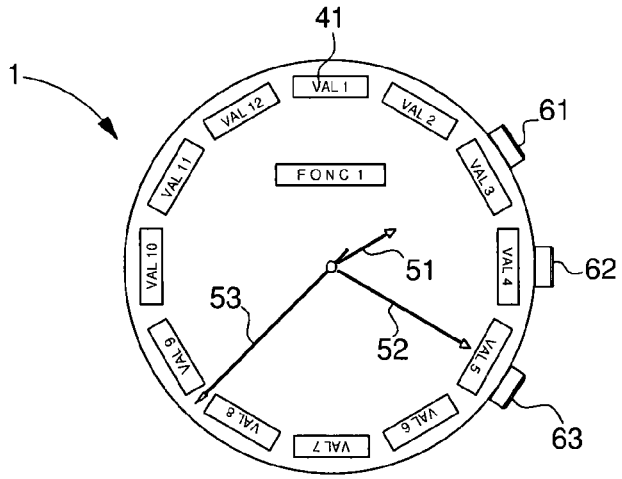

In a first alternative seen in FIG. 9, it is possible to display three pieces of value information [val] in the same manner as in the first alternative of the first embodiment. To do this, dial 7 further includes a central indicator 41*a*. This central indicator 41*a* is used to display the selected function [fonc]. Indicators 41 are used to display the values [val], whereas the three hands 51, 52, and 53 are used to display different information, such as, for example, a desired value, the measured value and a mean value, respectively [val 3], [val 5] and a value [val] comprised between [val 8] and [val 9].

In a second alternative to this second embodiment, this third, seconds hand 53 can display an additional piece of information. Indeed, the various functions [fonc] integrated in the watch are distributed in different menus [menu]. "Menu" means a group of different functions [fonc] which are grouped according to at least one common criterion. For example, the functions could be grouped together according to the sensor 35, 36, 37 used.

Figure 10A:
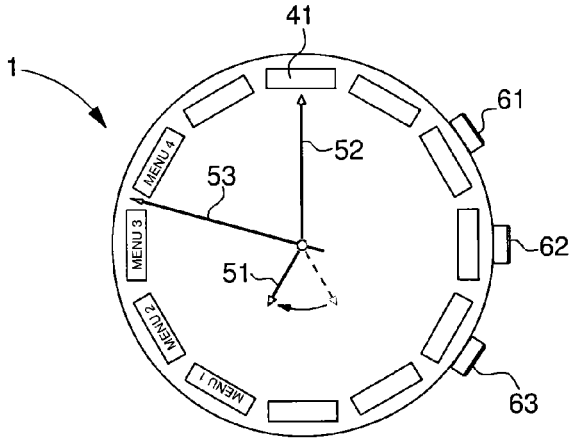
FIGS. 10*a*, 10*b* and 10*c* show a second alternative of the second embodiment of the watch according to the present invention.

The second step, shown in FIG. 10*a* consists in selecting the desired menu [menu]. To do this, the LDC indicators 41 whose position corresponds, for example, to the 7 o'clock, 8 o'clock, 9 o'clock and 10 o'clock time indications, automatically display different menus [menu]. The hour hand 51 moves automatically to point to the menu [menu] selected by the user via control means 6, which here is menu [menu 1].

Figure 10B:
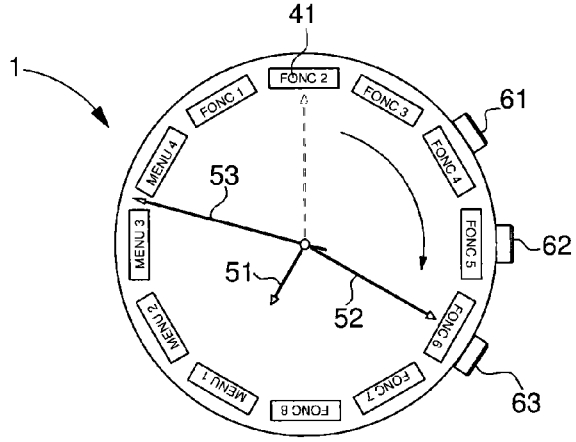

In a third step shown in FIG. 10*b*, the other indicators 41, i.e. the LCD indicators 41 whose position corresponds to the 11 o'clock to 6 o'clock time indications, are used for the display of functions [fonc] associated with the selected menu [menu]. The user then selects the function [fonc] which he desires and the minute hand 52 then moves to point to this function [fonc].

Figure 10C:
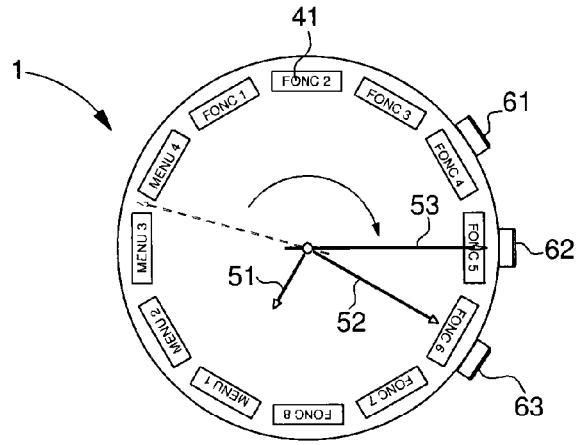

In a fourth step shown in FIG. 10*c*, the seconds hand 53 is used to display the value [val] measured when the selected function [fonc] is actuated. To do this, this hand 53 moves automatically along a scale of values which may be a scale printed on dial 7 or the bezel. In the case shown in FIG. 10*c*, the user has selected the function [fonc 6] from menu [menu 1].

Figure 11A:
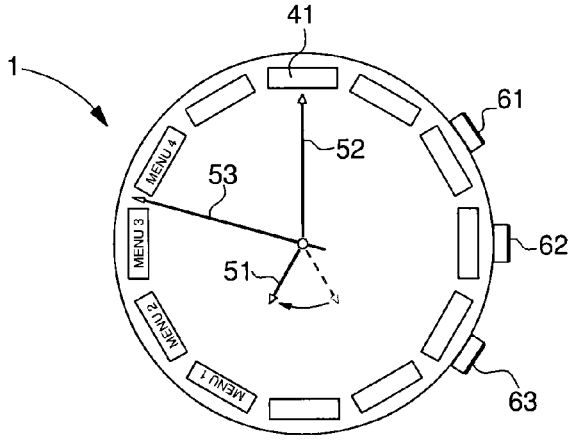
FIGS. 11*a* to 11*d* show a first variant of the second alternative of the second alternative of the second embodiment of the watch according to the present invention.

According to a first variant of the second alternative, the second step shown in FIG. 11*a* is identical to that of the second alternative, i.e. the user selects the menu [menu] that he desires, and hour hand 51 automatically points to this menu [menu].

Figure 11B:
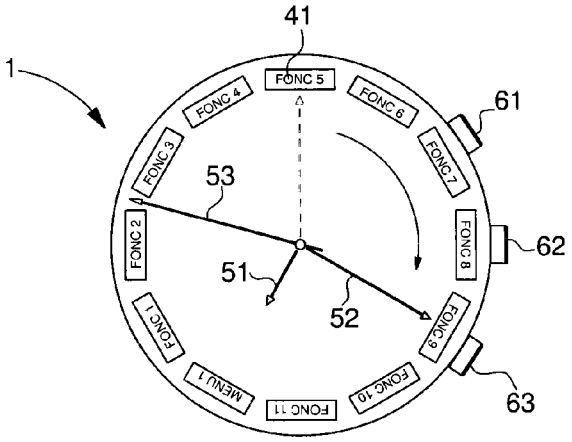

In a third step shown in FIG. 11*b*, the indicators 41 which are not used to display menus [menu] are used to display the functions [fonc] associated with the selected menu [menu]. The user selects the function [fonc] that he desires and, consequently, the minute hand 52 moves to point to this function [fonc].

Figure 11C:
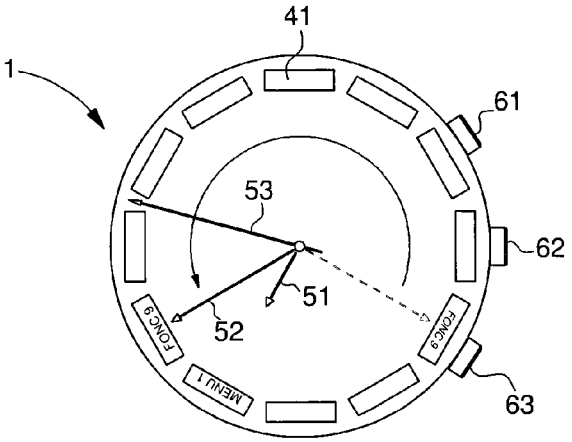

Between the third and fourth step, all of indicators 41, except the indicator 41 indicating the selected menu [menu] and the indicator 41 indicating the selected function [fonc], are automatically erased or extinguished as seen in FIG. 11*c*. Then, the indicator 41 indicating the selected function [fonc] is automatically erased, and its content is then transferred to an indicator 41 next to the one indicating the selected menu [menu]. The minute hand 52 automatically moves to point to this indicator 41. The indicator 41 indicating the selected menu [menu] and that indicating the selected function [fonc] are thus next to each other.

Figure 11D:
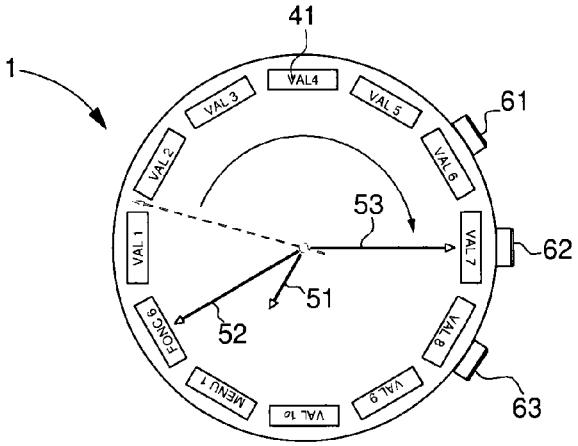

In the fourth step shown in FIG. 11*d*, the indicators 41 that were previously erased are used to display a range of values [val] associated with the selected function. The movement of the seconds hand 53 is then controlled by control system 3 according to the sensor associated with the function [fonc] so as to indicate to the user the value [val] measured when the selected function is actuated.

Figure 12A:
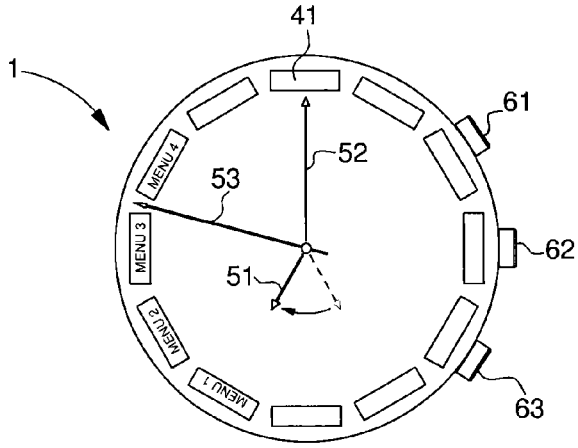
FIGS. 12*a* to 12*d* show a second variant of this second alternative of the second embodiment of the watch according to the present invention.

According to a second variant of the second alternative, the second step shown in FIG. 12*a* is identical to that of the first variant, i.e. the user selects the menu [menu] he desires, to which hour hand 51 automatically points.

Figure 12B:
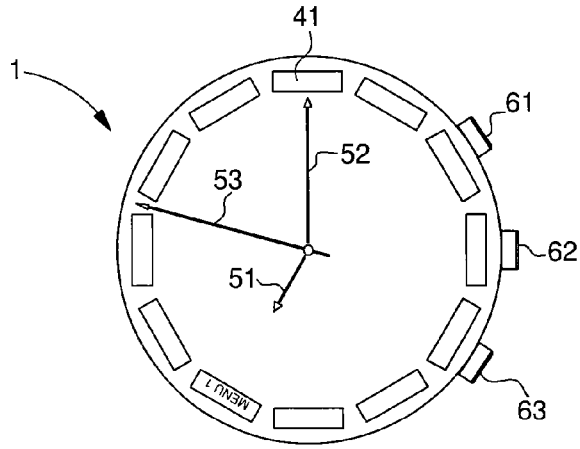

Between the second and third step, all of the indicators 41, except for the indicator 41 indicating the selected menu [menu], are automatically erased or extinguished as seen in FIG. 12*b*.

Figure 12C:
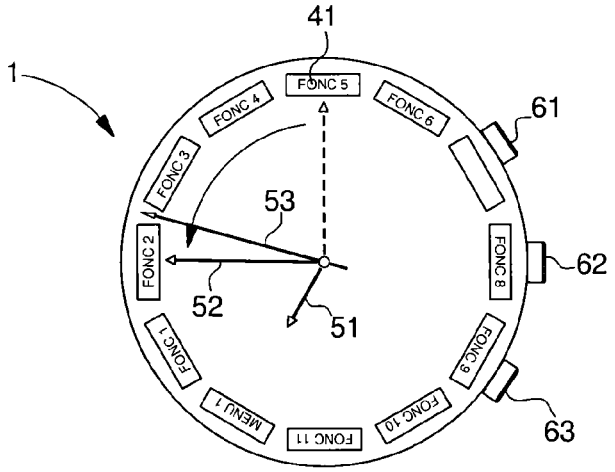

In the third step shown in FIG. 12*c*, the indicators 41 which were previously erased or extinguished, are used for the display of the functions [fonc] associated with the selected menu [menu]. There are therefore 11 functions [fonc] which can be selected. The user then selects the function [fonc] he desires and, consequently, the minute hand 52 moves to point to this function [fonc]. The intermediate step between the second and third steps allows more functions [fonc] to be displayed.

Between the third and fourth steps, all of the indicators 41, except indicator 41 indicating the selected menu [menu] and the indicator 41 indicating the selected function, are erased or extinguished by control system 3. Then, the indicator 41 indicating the function [fonc] is erased and the content thereof is transferred to an indicator 41 next to the one indicating the selected menu [menu]. The minute hand 52 then automatically moves to point to this indicator 41. The indicator 41 indicating the selected menu [menu] and that indicating the selected function [fonc] are thus next to each other.

Figure 12D:
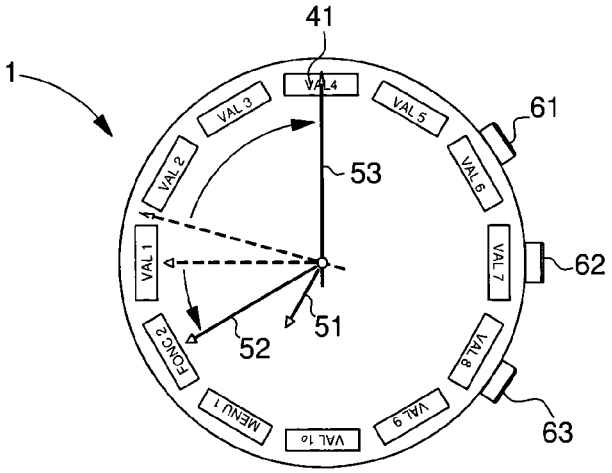

In the fourth step shown in FIG. 12*d*, the indicators 41 that were previously erased are used to display a range of values [val] associated with the selected function. The seconds hand 53 automatically moves so as to indicate to the user the value [val] measured when the selected function [fonc] is actuated.

This second variant means that only useful information is displayed and consequently provides improved legibility.

Figure 13:
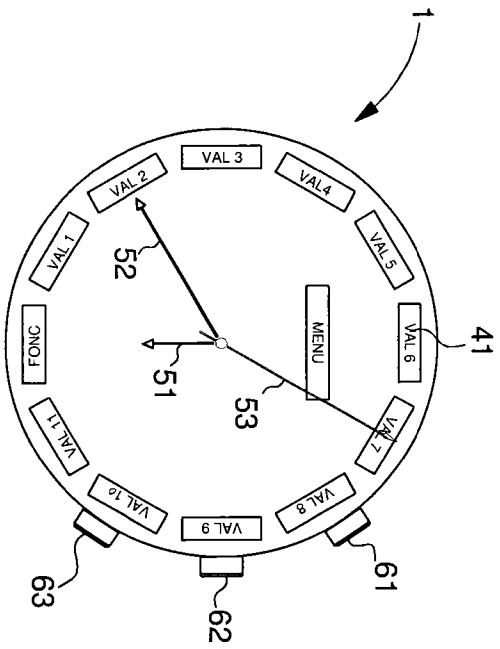
FIG. 13 shows a third variant of the second alternative of the second embodiment of the watch according to the present invention.

In a third variant seen in FIG. 13, it is possible to display at least two pieces of value information. To do this, the principle of the first alternative of the first embodiment is used and dial 7 further includes at least one central indicator 41*a*. This central indicator 41*a* is used to display the menu [menu] once the latter has been selected. The indicators 41 are then used for the selection of the desired function [fonc], with hand 51 automatically pointing to this indicator 41. All of the other indicators 41 are then used to display values [val]. The other two hands 52, 53 are used for displaying different information, such as, for example, a desired value and the measured value. It is also possible to envisage that dial 7 includes two central indicators 41*a* and 41*b* for displaying the selected menu [menu] and the selected function [fonc]. The three hands 51, 52 and 53 are therefore used to display various pieces of information.

In a fourth variant, it is possible to display at least one piece of value information linked to a function while displaying the time. To achieve this, dial 7 includes two central indicators 41*a* and 41*b* for displaying the selected menu [menu] and the selected function [fonc]. The indicators 41 are then used to display a range of value [val] linked to this function [fonc]. The seconds hand 53 is then used to point automatically to the value resulting from performance of this function [fonc]. The two hands 51, 52 are then used respectively to display the hours and the minutes.

Figure 14:
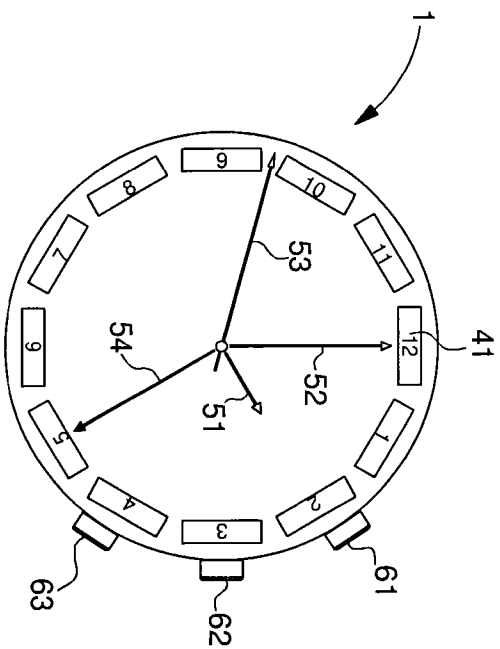
FIG. 14 shows a third embodiment of the watch according to the present invention.

According to a third embodiment visible in FIG. 14, the timepiece 1 includes a fourth hand 54. This hand 54 can be used, in the normal operating mode, as an indicator of a second time zone as seen in FIG. 14. In this second operating mode, this second hand may play several parts.

First of all, hand 54 may be used to indicate a value [val] associated with the function. Referring to the first embodiment, the user has a hand 51 indicating the function used and three hands 52, 53 and 54 for indicating values associated with said function.

Referring to the second alternative of the second embodiment, where the functions are distributed in menus, the user would thus have two hands 51, 52 to indicate the selected menu [menu] and the selected function [fonc] and two hands 53, 54 indicating values associated with the selected function [fonc]. Hand 54 may indicate a value [val] representing a maximum, minimum, mean value, desired value or other value. It is possible to envisage the two hands 53, 54 being capable of displaying a decimal value. One of the hands consequently points to the units number while the other hand points to the decimal value.

Secondly, this hand 54 can be used to indicate a sub-menu [s-menu] or a function [fonc]. A "sub-menu" means the distribution of the functions [fonc] of the same group into a smaller group, each group having its own criteria. It is possible for the functions of the timepiece to be classified in menus [menu] and sub-menus [s-menu] to allow a more complete system of hierarchy. Therefore three hands 51, 52 and 53 are needed to indicate the menu [menu], sub-menu [s-menu] and function [fonc] and a hand 54 for indicating the value [val] associated with the function. In this configuration, the principle consisting in gradually erasing or extinguishing the unused indicators 41 can be used and allows new information to be displayed while improving legibility.

Thus, the timepiece is arranged to display, first of all, the various menus [menu]. The user selects a menu [menu] causing the display of the sub-menus [s-menu] associated with the selected menu [menu]. Once the sub-menu [s-menu] has been selected, the indicators 41 displaying a piece of information which is neither the selected menu [menu], or sub-menu [s-menu], are erased. The display is modified so that this information concerning the selected menu [menu] and sub-menu [s-menu] is displayed on one of the neighbouring indicators 41. The functions [fonc] associated with the selected sub-menu [s-menu] are automatically displayed on the remaining indicators 41. The user selects the desired function [fonc] causing a modification in the display. This automatic modification consists in erasing the unused indicators 41, i.e. the indicators 41 displaying the functions [fonc] that have not been selected. The display of the selected function [fonc] is transferred to an indicator 41 next to the one displaying the selected menu [menu] or the one displaying the selected sub-menu [s-menu]. This modification of the display leaves indicators 41 free to display the range of values [val]. The last available hand 54 can indicate to the user the value associated with the selected function.

It will thus be clear that this fourth hand 54 can display additional information and thus increase the possible number of functions. Likewise, this fourth hand 54 permits the display of two functions [fonc] each having a value. For example, the watch 1 may display the instantaneous temperature in one colour and the mean temperature in another colour so that the information can be read distinctly.

In an alternative to this third embodiment, the timepiece may be arranged to display at least two pieces of value information [val] for two different functions [fonc]. To do this, dial 7 includes two indicators 41 used to display a first function [fonc1] and a second function [fonc2]. The other indicators 41 are then separated into two groups each forming a range of value [val] each linked to a function [fonc]. Each of hands 51, 52 points towards one of indicators 41 displaying a function [fonc]. Hands 53 and 53 are then each automatically pointed towards a value of a range of value [val] to display the result connected to the function [fonc]. Generally, it is possible to envisage that, in the second operating mode, the display of the hour and minutes indication is maintained. The hour hand 51 and minute hand 52 are thus used to indicate the hours and minutes. The user can then select a function and seconds hand 53 then moves automatically to indicate the measured value [val]. This value [val] is comprised within a range of values [val] displayed by indicators 41. In the simplest case, the indicators 41 which display the hour circle in the first operating mode are erased during activation of the second operating mode to display the various functions [fonc]. Once a function has been selected, the indicators 41 then display the range of value [val]. In another case, the digital display means 4 includes two series of indicators 41: a first series for displaying the hour circle and a second for displaying the range of value [val].

It will be clear that various alterations and/or improvements and/or combinations evident to those skilled in the art may be made to the various embodiments of the invention set out above without departing from the scope of the invention defined by the annexed claims.

It will also be clear that the timepiece may include more than 12 indicators 41. The timepiece may therefore include, for example 16 indicators 41, wherein 12 form the hour circle and 4 others are distributed on a circle inside the hour circle. Preferably, the radius of the circle is equal to the radius of said hour hand 51. It will be clear that it is possible to have various indicators 41 arranged in different circles. Each circle of indicators has a radius equal to one of the radii of the hands. Of course, it will be clear that the indicators 41 may be arranged in a different manner to an hour circle. It is possible for indicators 41 to be arranged in the form of a circle but off-centre relative to the centre of the dial. It is also possible for indicators 41 to be arranged in the form of an off-centre circle relative to the centre of the dial and for hands 51, 52 and 53 to be arranged not at the centre of the dial but elsewhere. Preferably, hands 51, 52 and 53 are arranged at the centre of the circle formed by indicators 41, the radius of the circle of indicators 41 being equal to the length of one of hands 52 and 53.

It is also clear that during the change from normal operating mode to special operating mode, the time indication is stored in the memory. When the special operating mode is no longer being carried out and the operating mode becomes normal again, the time indication is displayed again. This time indication is preferably automatically updated by processor 31.

The background colour of the indicators may also vary from one indicator to another and the various information may be represented by symbols and/or colours. Further, activation of control means 6 to change from the first operating mode to the second operating mode may allow the language of the information on indicators 41 to be changed. It is then possible to imagine seeing information displayed in Arabic, Chinese, Japanese or Roman characters or in any other imaginable language.

What is claimed is:

1. A watch, comprising:

a case in which there is arranged a control system, which includes a time base and is arranged to be able to perform several functions;

at least two analogue display elements and digital display means, which are controlled independently by said control system; and a control means acting on said control system, wherein the digital display means includes a plurality of discontinuous digital display sectors, wherein said watch is arranged, in a first, normal, operating mode, to provide the user with a time indication via at least the two analogue display elements driven by the control system provided with the time base, and wherein the watch is arranged, in a second, special, operating mode, to enable user to select at least one of the functions via the control means, to display on each of the digital display sectors at least one value or parameter, the values or parameters displayed on the digital display sectors combine to form a range associated with the at least one function selected by the control means, and to move at least one of the analogue display elements to point to the value or parameter displayed on at least one of the digital display sectors and associated with the selected function.

2. The watch according to claim 1, wherein the watch is arranged, in the second, special, operating mode, to allow the user to select at least one of the functions via the control means, to display on the digital display means indications of the watch functions and at least one value or parameter associated with the at least one function selected by the control means, and to move one of the analogue display means opposite the indication of the selected function and the other analogue display element opposite the value or parameter associated with the selected function.

3. The watch according to claim 1, wherein the digital display sectors are arranged on a dial or under a pierced or semi-transparent dial of said watch, each display sector being arranged, in the second, special, operating mode, to display an indication of one of the functions of said watch, or a value or parameter associated with a selected function.

4. The watch according to claim 3, wherein the digital display means takes the form of a single substrate on which several digital display sectors are formed.

5. The watch according to claim 4, wherein the digital display sectors are formed by the pierced dial.

6. The watch according to claim 3, wherein each of the digital display sections is arranged to display information in a first colour on a background in a second colour, which may be identical to the colour of the watch dial.

7. The watch according to claim 6, wherein the shape, number, size, first and second colours or position of the digital display sectors change according to the menu or function selected.

8. The watch according to claim 3, wherein the digital display means includes at least twelve of the digital display sectors arranged on a periphery of the dial like hour symbols.

9. The watch according to claim 8, wherein at least one of the digital display sectors is arranged inside a circle formed by the at least twelve digital display sectors arranged on the periphery of the dial.

10. The watch according to claim 1, wherein the analogue display elements are hands.

11. The watch according to claim 1, wherein the analogue display elements are discs.

12. The watch according to claim 1, wherein the digital display means takes the form of several substrates each forming one of the digital display sectors.

13. The watch according to claim 1, wherein the watch is arranged, in the second, special, operating mode, to continue to provide the user with a time indication via at least the two analogue display elements.

14. The watch according to claim 1, wherein the control means includes buttons.

15. The watch according to claim 1, wherein the digital display means includes at least one LCD display.

16. The watch according to claim 1, wherein in the first, normal, operating mode, the at least two analogue display elements point to the digital display sectors, to provide the user with the time indication and, in the second, special, operating mode, the at least one of the analogue display elements points to the value or parameter displayed on at least one of the digital display sectors and associated with the selected function.

17. The watch according to claim 3, wherein the digital display sectors are arranged on a periphery of the dial, in the first, normal, operating mode, each of the digital display sectors displays an hour symbol and the at least two analogue display elements point to the digital display sectors to provide the user with the time indication, and in the second, special, operating mode, the at least one of the analogue display elements points to the value or parameter displayed on at least one of the digital display sectors and associated with the selected function.

18. A watch, comprising:

a case in which there is arranged a control system, which includes a time base and is arranged to be able to perform several functions;

at least two analogue display elements and digital display means which are controlled independently by said control system; and a control means acting on said control system, wherein said watch is arranged, in a first, normal, operating mode, to provide the user with a time indication via at least the two analogue display elements driven by the control system provided with the time base, wherein the watch is arranged, in a second, special, operating mode, to enable the user to select at least one of the functions via the control means, to display on the digital display means at least one value or parameter associated with the at least one function selected by the control means, and to move at least one of the analogue display elements opposite the value or parameter associated with the selected function, wherein said watch includes three hands, wherein in the second, special, operating mode of the watch, a first analogue display element is arranged to point in the direction of the indication of a selected function, and wherein a second analogue display element is used to point in the direction of a first value or a first parameter associated with a selected function, and a third analogue display element is used to point in the direction of a second value or a second parameter associated with the selected function.

19. The watch according to claim 18, wherein the third analogue display element is arranged to merge with the first or second analogue display element.

20. The watch according to claim 18, wherein the control means includes buttons and the digital display means includes at least one LCD display.

21. A watch, comprising:

a case in which there is arranged a control system, which includes a time base and is arranged to be able to perform several functions;

at least two analogue display elements and digital display means, which are controlled independently by said control system; and a control means acting on said control system, wherein said watch is arranged, in a first, normal, operating mode, to provide the user with a time indication via at least the two analogue display elements driven by the control system provided with the time base, wherein the watch is arranged, in a second, special, operating mode, to enable user to select at least one of the functions via the control means, to display on the digital display means at least one value or parameter associated with the at least one function selected by the control means, and to move at least one of the analogue display elements opposite the value or parameter associated with the selected function, wherein the functions are grouped together in various menus and wherein said watch includes three analogue display elements so that, in the second, special, operating mode of the watch, a first analogue display element points in the direction of the indication of a selected menu, a second analogue display element points in the direction of the indication of a selected function and a third analogue display element is used to point in the direction of a value or parameter associated with the selected function.

22. The watch according to claim 21, wherein the control means includes buttons and the digital display means includes at least one LCD display.

* * * * *